US010892119B2

(12) United States Patent
Doro

(10) Patent No.: US 10,892,119 B2
(45) Date of Patent: Jan. 12, 2021

(54) PUSH SWITCH

(71) Applicant: Panasonic Intellectual Property Management Co., Ltd., Osaka (JP)

(72) Inventor: Kunio Doro, Okayama (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/473,940

(22) PCT Filed: Dec. 4, 2017

(86) PCT No.: PCT/JP2017/043400

§ 371 (c)(1),
(2) Date: Jun. 26, 2019

(87) PCT Pub. No.: WO2018/159048

PCT Pub. Date: Sep. 7, 2018

(65) Prior Publication Data

US 2019/0348233 A1 Nov. 14, 2019

(30) Foreign Application Priority Data

Feb. 28, 2017 (JP) ..... 2017-037685

(51) Int. Cl.
*H01H 13/14* (2006.01)

(52) U.S. Cl.
CPC ..... *H01H 13/14* (2013.01); *H01H 2205/002* (2013.01)

(58) Field of Classification Search
CPC ..... H01H 13/14; H01H 2205/002
(Continued)

(56) References Cited

U.S. PATENT DOCUMENTS 5,610,950 A 3/1997 Duch
7,196,280 B2 3/2007 Rochon
(Continued)

FOREIGN PATENT DOCUMENTS

JP 54-21583 A 2/1979
JP 2002324454 * 8/2002 ..... H01H 3/12
(Continued)

OTHER PUBLICATIONS

International Search Report dated Jan. 9, 2018, issued in counterpart International Application No. PCT/JP2017/043400 (1 page).
(Continued)

*Primary Examiner* — Nguyen Tran
*Assistant Examiner* — Iman Malakooti
(74) *Attorney, Agent, or Firm* — Westerman, Hattori, Daniels & Adrian, LLP

(57) ABSTRACT

A push switch includes: a first fixture contact; a second fixture contact; a member that holds the first and second fixture contacts; a movable member positioned opposite a surface of the member in an operation direction; and a contact member. The contact member includes: a first support and a second support that are supported by the member; and a joint that joins the first support to the second support. The movable joint is disposed between the joint of the movable member and the member, with neither the first support nor the second support overlapping the movable member in a planar view.

7 Claims, 9 Drawing Sheets

(58) Field of Classification Search
USPC ..... 200/5 A, 341
See application file for complete search history.

(56) References Cited

U.S. PATENT DOCUMENTS

| | | | | |
|---|---|---|---|---|
| 8,735,747 | B2 | 5/2014 | Bigand | |
| 8,835,787 | B2 | 9/2014 | Takeuchi et al. | |
| 2006/0131153 | A1* | 6/2006 | Asada | H01H 13/48 200/341 |
| 2007/0039811 | A1 | 2/2007 | Yanai et al. | |
| 2013/0068599 | A1 | 3/2013 | Kikuchi | |
| 2014/0110237 | A1 | 4/2014 | Enomoto et al. | |
| 2015/0194278 | A1 | 7/2015 | Dromph et al. | |

FOREIGN PATENT DOCUMENTS

| | | | |
|---|---|---|---|
| JP | 2002-324454 | A | 11/2002 |
| JP | 2004-311128 | A | 11/2004 |
| JP | 2015-522211 | A | 8/2015 |

OTHER PUBLICATIONS

Non-Final Office Action dated Mar. 26, 2020, issued in U.S. Appl. No. 16/473,943 (13 pages).

* cited by examiner

PUSH SWITCH

This application is a U.S. national stage application of the PCT international application no. PCT/JP2017/043400 filed on Dec. 4, 2017, which claims the benefit of foreign priority of Japanese patent application No. 2017-037685 filed on Feb. 28, 2017, the contents all of which are incorporated herein by reference.

TECHNICAL FIELD

The present disclosure relates to push switches, and more specifically to a push switch that is turned on or off by deformation of a movable member.

BACKGROUND ART

So-called normally-closed push switches in which electricity is conducted between contacts during non-operation but not conducted during operation are known recently (for example, refer to PTL 1 and PTL 2).

A press button switch disclosed in PTL 1 includes a housing, a first fixture contact, a second fixture contact, and a movable contact. The housing has a container. The first and second fixture contacts are disposed apart from each other on an inner bottom surface of the container. The movable contact is disposed above the first and second fixture contacts and formed into a dome shape having a reversible swelling section.

When the above press button switch is not operated, the movable contact makes contact with both the first and second fixture contacts. As a result, the first and second fixture contacts enter a conductive state, and a circuit thereby enters an ON state. When the dome-shaped swelling section of the movable contact in this state is pressed down, the movable contact is reversed to separate from the first and second fixture contacts. As a result, the first and second fixture contacts enter a nonconductive state, and the circuit thereby enters an OFF state.

A press button switch disclosed in PTL 2 includes a first terminal point, a second terminal point, a third terminal point, and a deformable contact element. In a first state, the deformable contact element is connected to only the first and second terminal points. In a second state, the deformable contact element is connected to only the first and third terminal points. In this way, the press button switch can assume both a normally-open state and a normally-closed state.

CITATION LIST

Patent Literature

PTL 1: Unexamined Japanese Patent Publication No. 2004-311128

PTL 2: Japanese Translation of PCT Publication No. 2015-522211

SUMMARY OF THE INVENTION

In the press button switch disclosed in PTL 1, the movable contact is provided with the swelling section formed into a dome shape. By pressing down this swelling section, the movable contact is reversed. This reversing is performed by buckling distortion of the movable contact. To cause this deformation without any trouble, it is necessary to reserve a large space for accommodating the movable contact.

In the press button switch disclosed in PTL 2, the deformable contact element also has a dome shape. It is thus necessary to reserve a large space for accommodating the movable contact, similar to the case of PTL 1.

A push switch according to a first aspect of the present disclosure includes a first fixture contact, a second fixture contact, a member section, a movable member, and a contact member. The member holds the first fixture contact and the second fixture contact. The movable member is positioned opposite a surface of the member in an operation direction. The contact member that possesses electrical conductivity is positioned on an opposite side of the movable member to the surface of the member in the operation direction. The movable member includes a first movable contact, a second movable contact, and a movable joint. The first movable contact moves between locations at which the first movable contact is in contact with the first fixture contact and at which the first movable contact is separated from the first fixture contact. The second movable contact moves between locations at which the second movable contact is in contact with the second fixture contact and at which the second movable contact is separated from the second fixture contact. The movable joint joins the first movable contact to the second movable contact and electrically connects the first movable contact to the second movable contact. The contact member includes: a first support and a second support that are supported by the member; and a joint that joins the first support to the second support. The movable joint is disposed between the joint and the member, with neither the first support nor the second support overlapping the movable member in a planar view.

The push switch according to a second aspect of the present invention further includes a press unit in addition to the configuration of the first aspect. The press unit is positioned on an opposite side of the movable member to the surface of the member in the operation direction. The movable joint includes third movable contact. The third movable contact includes a pressure receiving section. The third movable contact moves between locations at which the third movable contact is in contact with the contact member and at which the third movable contact is separated from the contact member. In a stationary state where no external force acts on the pressure receiving section, the first fixture contact is electrically connected to the contact member, and the first fixture contact is electrically connected to the second fixture contact. When the stationary state is transited to a first operation state where the pressure receiving section is pressed through the press unit toward the surface of the member in the operation direction, the third movable contact becomes separated from the contact member to break off an electrical connection between the first fixture contact and the contact member. When the first operation state is transited to a second operation state where the pressure receiving section is further pressed through the press unit, the first movable contact, becomes separated from the first fixture contact and the second movable contact becomes separated from the second fixture contact, to break off an electrical connection between the first fixture contact and the second fixture contact.

A push switch according to a third aspect of the present invention has, in addition to the configuration of the first or second aspect, a configuration in which the contact member includes a third fixture contact and a contact piece. The third fixture contact is held by the member. The contact piece is electrically connected to the third fixture contact. At least a portion of the contact piece is positioned on an opposite side of the movable member to the surface of the member in the operation direction.

The present disclosure can achieve a compact body, compared to conventional normally-closed push switches.

DESCRIPTION OF EMBODIMENT

A push switch according to an exemplary embodiment of the present disclosure will be described below with reference to the accompanying drawings. It should be noted that a configuration described below is merely one example of the present disclosure and thus does not limit the present disclosure. Therefore, besides the following components, various modifications are possible depending on design or the like without departing from the scope of the technical idea of the present invention.

Exemplary Embodiment (1) Outline

Figure 1:
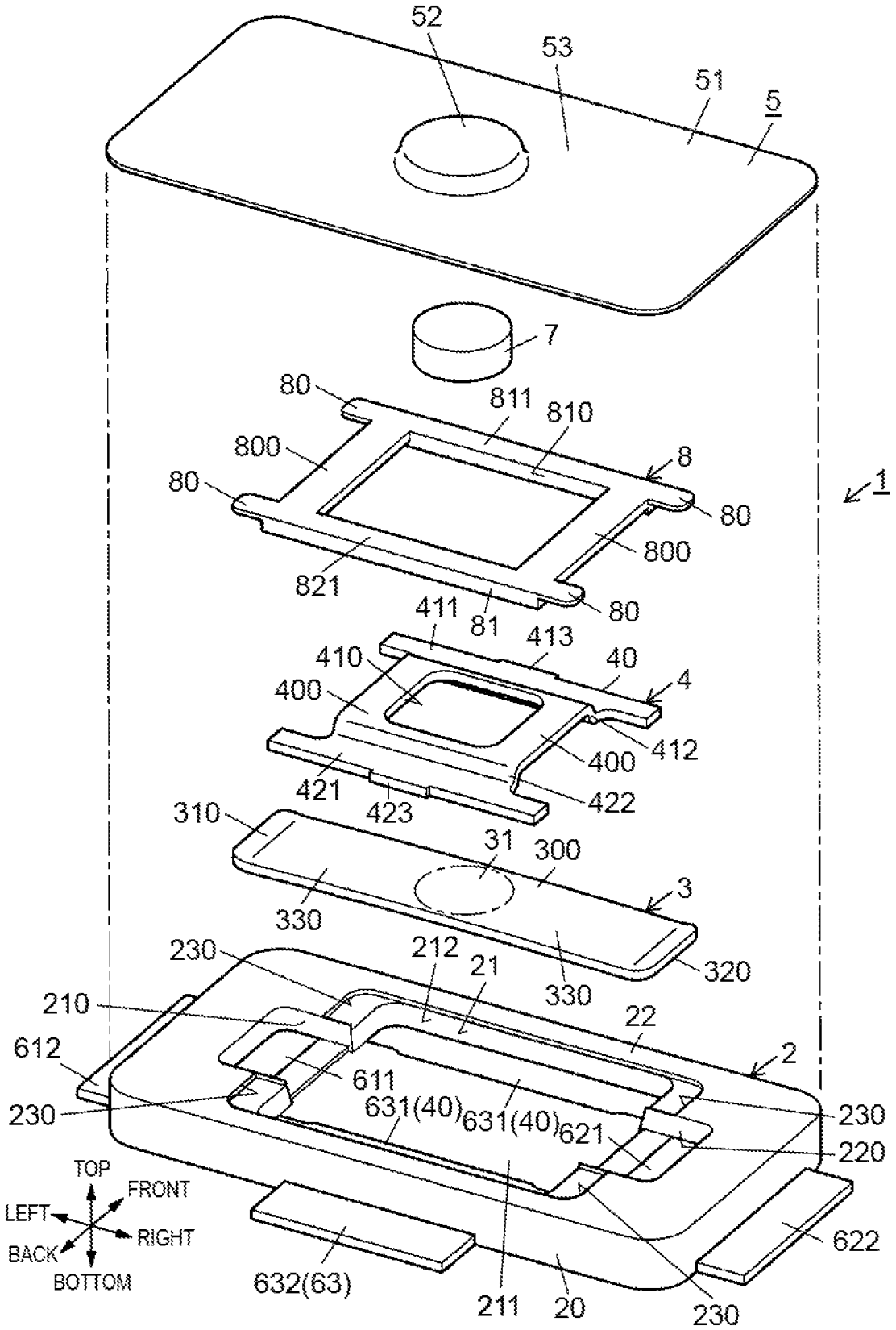
FIG. 1 is an exploded perspective view of a push switch according to an exemplary embodiment of the present disclosure.
Figure 2:
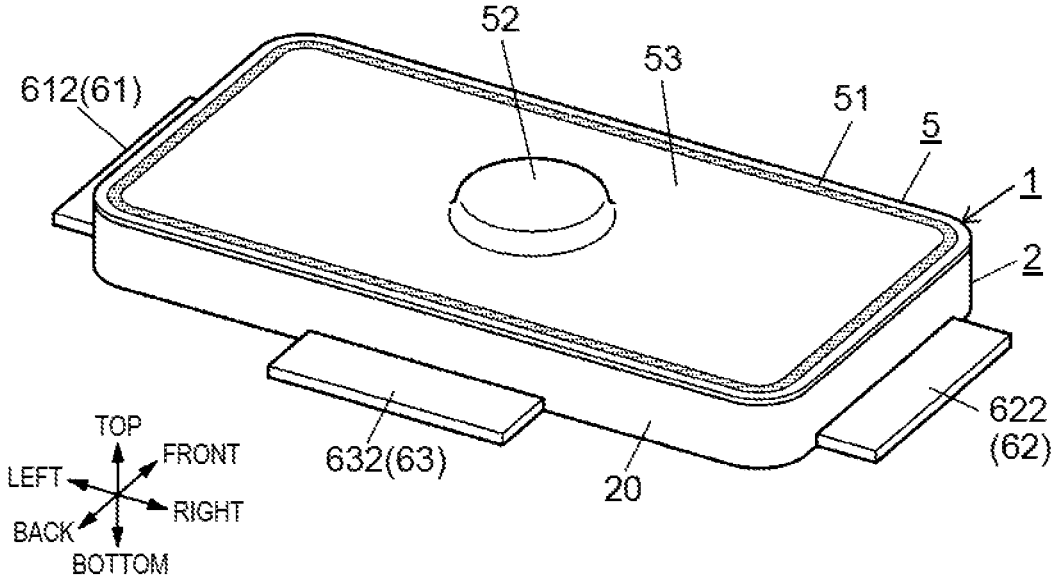
FIG. 2 is a perspective view of the push switch.
Figure 3:
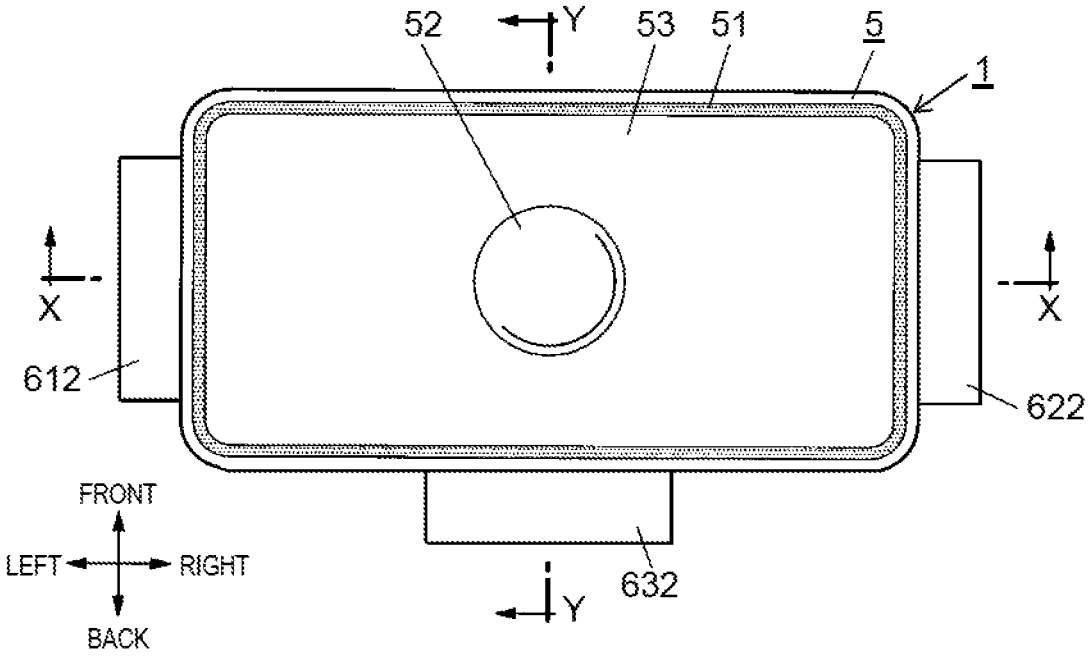
FIG. 3 is a plan view of the push switch.

As illustrated in FIGS. 1 and 2, push switch 1 according to this exemplary embodiment includes first fixture contact 611, second fixture contact 621, case 2, movable member 3, and contact member 4.

Case 2 holds first fixture contact 611 and second fixture contact 621.

Movable member 3 is positioned opposite surface 211 of base 20 in an operation direction (upward or downward direction).

Contact member 4 that possesses electrical conductivity is positioned on an opposite side of movable member 3 to surface 211 of base 20 in the operation direction.

Movable member 3 includes first movable contact 310, second movable contact 320, and movable joint 300. First movable contact 310 moves between locations at which first movable contact 310 is in contact with first fixture contact 611 and at which first movable contact 310 is separated from first fixture contact 611. Second movable contact 320 moves between locations at which second movable contact 320 is in contact with second fixture contact 621 and at which second movable contact 320 is separated from second fixture contact 621. Movable joint 300 joins first movable contact 310 to second movable contact 320 and electrically connects first movable contact 310 to second movable contact 320.

Contact member 4 includes: first support 411 and second support 421 that are supported by base 20; and joint 400 that joins first support 411 to second support 421.

Both first support 411 and second support 421 are supported by base 20 on both sides of movable member 3 in a second direction (forward or backward direction). This second direction is orthogonal to a first direction (right or left direction) in which first movable contact 310 is aligned with second movable contact 320. Each of the first and second directions is a direction in a plane orthogonal to the operation direction in which movable joint 300 is disposed between joint 400 and base 20.

In the above configuration, movable member 3 and contact member 4 are disposed so as to intersect each other. Thus, third fixture contacts 631 can be positioned so as to deviate from a straight line along which first fixture contact 611 is aligned with second fixture contact 621. As a result, this configuration can position first fixture contact 611, second fixture contact 621, and third fixture contacts 631 at short distances from one another in the operation direction. In short, the configuration can position first fixture contact 611, second fixture contact 621, and third fixture contacts 631 at similar heights.

Consequently, the push switch of the present disclosure can achieve a compact body, compared to conventional normally-closed push switches.

(2) Details

Push switch 1 that will be described below is applied to operation sections of various devices, such as information processing devices and electrical household devices. For example, push switch 1 is mounted on a printed circuit board inside a housing of a certain device. In this case, for example, an operation switch is disposed inside the housing at a location corresponding to push switch 1. By pressing down the operation switch, a user can indirectly operate push switch 1 through the operation switch.

Hereinafter, unless otherwise specified, a direction orthogonal to surface 211 of base 20 (a direction orthogonal to the page of FIG. 7) is defined as an "upward or downward direction"; a side of base 20 toward surface 211 in the upward or downward direction is defined as an "upward side"; and another side of base 20 toward the opposite surface in the upward or downward direction is defined as a "downward side". In the description that will be given below, the "operation direction" corresponds to the "upward or downward direction". A direction in which first terminal 612 and second terminal 622, described later, protrude from case 2 is defined as a "right or left direction". A direction orthogonal to both the upward or downward direction and the right or left direction (a direction orthogonal to the page of FIG. 8) is defined as a "forward or backward direction". In FIG. 1 and other drawings, various directions, including top, bottom, right, left, front, and hack, are defined, respectively, in accordance with the arrows indicating "top", "bottom", "right", "left", "front", and "back". However, it should be noted that these directions are not intended to specify usage directions of push switch 1. In addition, the arrows indicating the respective directions in the drawings are merely illustrated for description, and they are unsubstantial.

(2.1) Configuration

As illustrated in FIGS. 1 to 9, push switch 1 according to this exemplary embodiment includes case 2, first metal member 61, second metal member 62, movable member 3, contact member 4, holding plate 8, protective sheet 5, and press unit 7.

Case 2 includes base 20, details of which will be described later. First metal member 61 includes first fixture contact 611. Second metal member 62 includes second fixture contact 621. Contact member 4 includes contact piece 40 and third fixture contacts 631. Configurations in which contact member 4 includes contact piece 40 and third fixture contacts 631 include two configurations that will be described below. In the first configuration, contact piece 40 and third fixture contacts 631 are members that cannot be integrated and are included in contact member 4. In the second configuration, contact piece 40 and third fixture contacts 631 are independent members and included in contact member 4. Push switch 1 illustrated in FIG. 1 and other drawings employs the second configuration. Contact member 4 indicates both of contact piece 40 and third fixture contacts 631.

In other words, base 20 is at least a portion of case 2. First fixture contact 611 is at least a portion of first metal member 61. Second fixture contact 621 is at least a portion of second metal member 62. Each of contact piece 40 and third fixture contacts 631 is at least a portion of contact member 4.

In the following description, push switch 1 is in a state of not being operated, namely, push switch 1 is in a state of being not pressed down, unless otherwise specified.

Case 2 is made of a synthetic resin that possesses electrical insulation. Case 2 has a cuboid shape having flat surfaces in the upward or downward direction. Case 2 has depression 21 that is open upward. In this case, case 2 includes: base 20 having a sheet shape; and peripheral wall 22 protruding upward from the outer edge of surface 211 of base 20. In this exemplary embodiment, base 20 is formed into a rectangular shape that extends in the right or left direction as seen from the top. Peripheral wall 22 is formed into a rectangular frame shape as seen from the top. In this configuration, a space surrounded by surface 211 of base 20 and inner surface 212 of peripheral wall 22 corresponds to depression 21. In other words, surface 211 of base 20 is a bottom surface of depression 21, and inner surface 212 of peripheral wall 22 is an inner surface of depression 21. Therefore, an amount by which peripheral wall 22 protrudes from surface 211 of base 20 corresponds to a depth of depression 21.

An aperture shape of depression 21 is a substantially square shape. In this exemplary embodiment, depression 21 is formed with its right and left sides protruding outward at the respective centers, as seen from the top.

Case 2 further includes first recess 210 and second recess 220. More specifically, a portion of depression 21 protruding from a left side forms first recess 210. The bottom surface of first recess 210 is positioned higher than the bottom surface (surface 211) of depression 21. A portion of depression 21 protruding from a right side forms second recess 220. The bottom surface of second recess 220 is positioned higher than the bottom surface of depression 21. As described above, each of first recess 210 and second recess 220 is provided with the bottom surface positioned higher than the bottom surface of depression 21. Furthermore, first recess 210 faces second recess 220. First recess 210 is a part that supports first movable contact 310 of movable member 3, details of which will be described later. Second recess 220 is a part that supports second movable contact 320 of movable member 3. Case 2 has a rectangular shape with its four corners chamfered, as seen from the top. However, the chamfering is not essential to push switch 1 and thus may be optional.

In this exemplary embodiment, case 2 has third recesses 230 on both sides of first recess 210 in the forward or backward direction. Likewise, case 2 has third recesses 230 on both sides of second recess 220 in the forward or backward direction. In short, case 2 has four third recesses 230. Each of third recesses 230 is formed so as to be depressed downward from an upper surface of peripheral wall 22. A bottom surface of each third recess 230 is positioned above surfaces of first recess 210 and second recess 220. Four third recesses 230 are parts used to fix holding plate 8 at four corners, details of which will be described later.

First metal member 61, second metal member 62, and third metal member 63, each of which is made of a metal plate that possesses electrical conductivity, are held by base 20 of case 2. All of first metal member 61, second metal member 62, and third metal member 63 may be integrated with case 2 through insert molding, for example. In this exemplary embodiment, first metal member 61 is disposed on a left side of base 20; second metal member 62 is disposed on a right side of base 20; and third metal member 63 is disposed between first metal member 81 and second metal member 62. First metal member 61, second metal member 62, and third metal member 63 are electrically insulated from one another.

First metal member 61 includes first fixture contact 611 and first terminal 612. First fixture contact 611 is positioned on a right side of first metal member 61 in the right or left direction, whereas first terminal 612 is positioned on a left side of first metal member 61 in the right or left direction. More specifically, first metal member 61 further includes first main plate 613 joined to first terminal 612. Of first main plate 613, a portion protruding in a right direction has an upper surface. A (right) portion of this upper surface forms first fixture contact 611. First fixture contact 611, first terminal 612, and first main plate 613, which are integrally formed as a single metal plate, are electrically interconnected (refer to FIG. 8).

Figure 7:
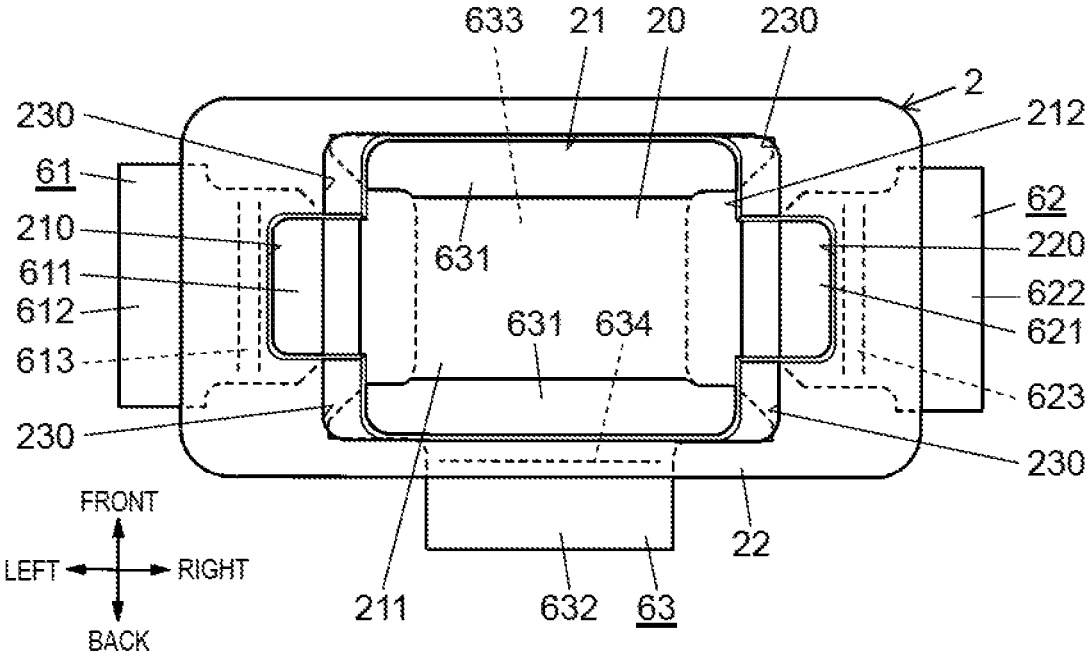
FIG. 7 is a plan view of the push switch from which a movable member is further removed.
Figure 8:
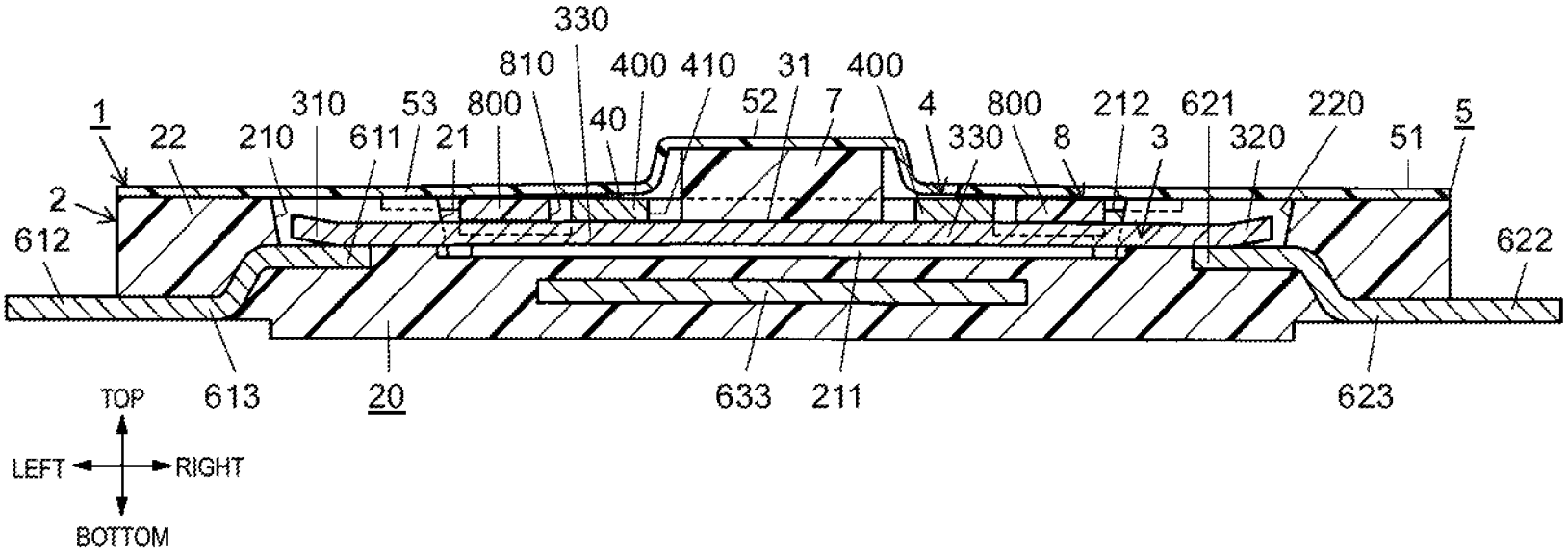
FIG. 8 is a cross-sectional view taken along a line X-X in FIG. 3.

As illustrated in FIG. 7, at least a portion of first main plate 613 is embedded in case 2 (member) so that first metal member 61 is held by case 2. Another portion of first main plate 613 is exposed from the bottom surface of first recess 210. The portion of first main plate 613 exposed from the bottom surface of first recess 210 has an upper surface flush with the bottom surface of first recess 210. A right portion of first main plate 613 is exposed upward from a substantially left half portion of the bottom surface of first recess 210. This exposed portion forms first fixture contact 611. In short, first fixture contact 611 is positioned on the bottom surface of first recess 210.

Second metal member 62 includes second fixture contact 621 and second terminal 622. Second fixture contact 621 is positioned on a left side of second metal member 62 in the right or left direction, whereas second terminal 622 is positioned on a right side of second metal member 62 in the right or left direction. More specifically, second metal member 62 further includes second main plate 623 joined to second terminal 622. Of second main plate 623, a portion protruding in a left direction has an upper surface. A (left) portion of this upper surface forms second fixture contact 621. Second fixture contact 621, second terminal 622, and second main plate 623, which are integrally formed as a single metal plate, are electrically interconnected (refer to FIG. 8).

At least a portion of second main plate 623 is embedded in case 2 (member) so that second metal member 62 is held by case 2. In this case, as illustrated in FIG. 7, another portion of second main plate 623 is exposed from the bottom surface of second recess 220. The portion of second main plate 623 exposed from the bottom surface of second recess 220 has an upper surface flush with the bottom surface of second recess 220. A left portion of second main plate 623 is exposed upward from a substantially right half portion of the bottom surface of second recess 220. This exposed portion forms second fixture contact 621. In short, second fixture contact 621 is positioned on the bottom surface of second recess 220.

Figure 9:
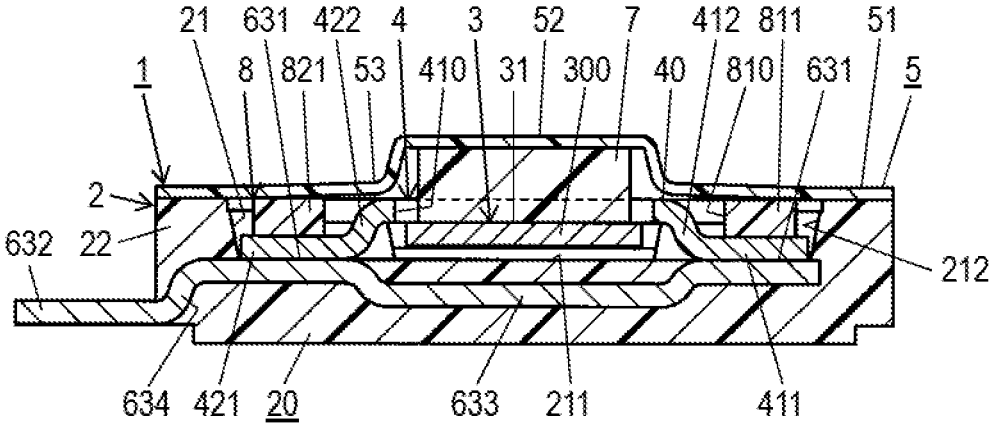
FIG. 9 is a cross-sectional view taken along a line Y-Y in FIG. 3.

Third metal member 63 includes a pair of (two) third fixture contacts 631 and third terminal 632. A first one of third fixture contacts 631 is positioned on a front side of third metal member 63 in the forward or backward direction. Third terminal 632 is positioned on a hack side of third metal member 63 in the forward or backward direction. A second one of third fixture contacts 631 is positioned between the first one of third fixture contacts 631 and third terminal 632. More specifically, as illustrated in FIG. 7 or 9, third metal member 63 further includes: sub-plate 634 joined to third terminal 632; and third main plate 633 joined to sub-plate 634. A front portion of an upper surface of third main plate 633 forms the first one of third fixture contacts 631. A portion of an upper surface of a joint portion of third main plate 633 and sub-plate 634 forms the second one of third fixture contacts 631. The pair of third fixture contacts 631, third terminal 632, third main plate 633, and sub-plate 634, which are integrally formed as a single metal plate, are electrically interconnected (refer to FIG. 9).

At least a portion of third main plate 633 is embedded in case 2 (member) so that third metal member 63 is held by case 2. In this case, as illustrated in FIG. 7, a portion of third main plate 633 is exposed from the bottom surface (surface 211) of depression 21. The portion of third main plate 633 exposed from the bottom surface of depression 21 has an upper surface flush with the bottom surface of depression 21. A front portion of third main plate 633 is exposed upward from a front edge of the bottom surface of depression 21. This exposed portion forms the first one of third fixture contacts 631. A back portion of third main plate 633 is exposed upward from a back edge of the bottom surface of depression 21. This exposed portion forms the second one of third fixture contacts 631. In this way, third fixture contacts 631 are held by case 2.

The bottom surfaces of first recess 210 and second recess 220 are positioned at the same height with respect to surface 211 of base 20. The bottom surface of first recess 210 is flush with the upper surface of first fixture contact 611. The bottom surface of second recess 220 is flush with the upper surface of second fixture contact 621. The bottom surfaces of four third recesses 230 are positioned at the same height with respect to surface 211 of base 20. The bottom surfaces of first recess 210 and second recess 220 are positioned higher than surface 211 of base 20. The bottom surfaces of four third recesses 230 are positioned higher than the bottom surfaces of first recess 210 and second recess 220.

First terminal 612 protrudes from a left surface of case 2. Second terminal 622 protrudes from a right surface of case 2. Third terminal 632 protrudes from a back surface of case 2. More specifically, first terminal 612 protrudes leftward from the left surface of case 2. Likewise, second terminal 622 protrudes rightward from the right surface of case 2. Third terminal 632 protrudes backward from the back surface of case 2. The lower surfaces of first terminal 612, second terminal 622, and third terminal 632 are flush with the lower surface of case 2. All of first terminal 612, second terminal 622, and third terminal 632 are mechanically coupled to and electrically connected to, for example, conductive members on a printed circuit board with soldering.

Push switch 1 is configured such that two circuits are turned on or off, details of which will be described in a section "(2.2) Operation". The two circuits include: a circuit having first terminal 612 and second terminal 622; and a circuit having first terminal 612 and third terminal 632. First terminal 612 is a common terminal shared by the two circuits.

Movable member 3 is disposed inside depression 21 of case 2. Movable member 3 is disposed inside depression 21 together with contact member 4. Movable member 3, contact member 4, and holding plate 8 are stacked in this order on the bottom surface (surface 211) of depression 21. Movable member 3 is positioned opposite surface 211 of base 20 in the operation direction. In short, movable member 3 is disposed between contact member 4 and the bottom surface of depression 21.

Movable member 3 is made of an elastic plate material, such as a metal plate made of stainless steel (SUS), for example. In short, movable member 3 is an elastically deformable member. Movable member 3 has a shape conforming to depression 21 so that movable member 3 can be accommodated in depression 21. Therefore, movable member 3 is formed to be slightly smaller than depression 21. In this exemplary embodiment, movable member 3 has a flat, rectangular shape and extends in the right or left direction.

More specifically, movable member 3 includes first movable contact 310, second movable contact 320, and movable joint 300. Movable joint 300 has third movable contact 330. In other words, each of first movable contact 310, second movable contact 320, and third movable contact 330 is at least a portion of movable member 3.

First movable contact 310 moves between locations at which first movable contact 310 is in contact with first fixture contact 611 and at which first movable contact 310 is separated from first fixture contact 611. At least a left portion of the lower surface of movable member 3 forms first movable contact 310. During non-operation of push switch 1, first movable contact 310 is in contact with first fixture contact 611. During operation of push switch 1, first movable contact 310 is kept in contact with or separated from first fixture contact 611, depending on a movement distance (displacement amount) of pressure receiving section 31 when pressure receiving section 31 is pressed down. Details of this will be described later.

An end of first movable contact 310 is curved away from first fixture contact 611. This structure facilitates the lateral sliding, in the right or left direction, of the end of first movable contact 310 on the upper surface of first fixture contact 611 when push switch 1 is operated. As a result, it is possible to reduce frictional force between first movable contact 310 and first fixture contact 611, thereby successfully suppressing metal chips from being generated due to the frictional force.

Second movable contact 320 moves between locations at which second movable contact 320 is in contact with second fixture contact 621 and at which second movable contact 320 is separated from second fixture contact 621. At least a right portion of the lower surface of movable member 3 forms second movable contact 320. During the non-operation of push switch 1, second movable contact 320 is in contact with second fixture contact 621. During the operation of push switch 1, second movable contact 320 is kept in contact with or separated from second fixture contact 621, depending on the movement distance (displacement amount) of pressure receiving section 31 when pressure receiving section 31 is pressed down. Details of this will be described later.

Similar to first movable contact 310, an end of second movable contact 320 is also curved away from second fixture contact 621. This structure facilitates the lateral sliding in the right or left direction, of the end of second movable contact 320 on the upper surface of second fixture contact 621 when push switch 1 is operated. As a result, it is possible to reduce frictional force between second movable contact 320 and second fixture contact 621, thereby successfully suppressing metal chips from being generated due to the frictional force.

Movable joint 300 joins first movable contact 310 to second movable contact 320 and electrically connects first movable contact 310 to second movable contact 320. Movable joint 300 is disposed between contact member 4 (especially, contact piece 40) and case 22. Third movable contact 330 that has pressure receiving section 31 moves between locations at which pressure receiving section 31 is in contact with contact member 4 and at which pressure receiving section 31 is separated from contact member 4. A portion of the upper surface of movable member 3 which is in contact with contact member 4 forms third movable contact 330. In this exemplary embodiment, a substantially central portion of the upper surface of movable joint 300 of movable member 3 forms pressure receiving section 31, whereas a portions of the upper surface of movable member 3 on right and left sides of pressure receiving section 31 forms third movable contact 330. As described above, substantially the central portion of movable joint 300 of movable member 3 functions as pressure receiving section 31, which receives external force (referred to below as "operation force") to be applied to push switch 1 when push switch 1 is operated. During the non-operation of push switch 1, third movable contact 330 is in contact with third fixture contacts 631, because third movable contact 330 is in contact with contact member 4. When pressure receiving section 31 is pressed down during the operation of push switch 1, movable joint 300 is warped downward. In response, third movable contact 330 becomes physically separated from contact member 4 (joint 400 in this exemplary embodiment). As a result, third movable contact 330 is released from third fixture contact 631 in terms of electrical connection. Details of this will be described later.

Movable member 3 is accommodated in depression 21 with its left end, including first movable contact 310, contained in first recess 210 and with its right end, including second movable contact 320, contained in second recess 220. More specifically, movable member 3 is accommodated in depression 21 with first movable contact 310 being in contact with first fixture contact 611 exposed from the bottom surface of first recess 210 and with second movable contact 320 being in contact with second fixture contact 621 exposed from the bottom surface of second recess 220. In short, movable member 3 is a member that electrically connects first fixture contact 611 to second fixture contact 621. Also, movable member 3 electrically interconnects first fixture contact 611, second fixture contact 621, and third fixture contacts 631 by making contact with contact member 4, details of which will be described later.

Contact member 4 is disposed inside depression 21 of case 2 together with movable member 3. As described above, movable member 3, contact member 4, and holding plate 8 are stacked on top of each other in the upward or downward direction. Contact member 4, which possesses electrical conductivity, is disposed on surface 211 of base 20 in the operation direction (upward or downward direction). More specifically, contact member 4 (especially, contact piece 40, which is a part of contact member 4) is disposed on an opposite surface (upper surface) of movable member 3 to surface 211 of base 20 in the operation direction. In short, contact member 4 (especially, contact piece 40) is disposed between movable member 3 and holding plate 8.

Contact member 4 possesses electrical conductivity. Contact member 4 is a metal plate made of stainless steel (SUS), for example. Contact member 4 is normally an undeformable member. Contact member 4 includes third fixture contacts 631 and contact piece 40 described above. Contact piece 40 possesses electrical conductivity. In the exemplary embodiment that will be described below, third fixture contacts 631 and contact piece 40 are independent members. However, third fixture contacts 631 and contact piece 40 may be integrated with each other (refer to modifications). Even if third fixture contacts 631 and contact piece 40 are independent members, contact piece 40 is electrically connected to third fixture contacts 631 regardless of whether a press operation is performed.

Contact piece 40 includes first support 411, second support 421, and a pair of (two) joints 400. Contact piece 40 further includes through-hole 410 surrounded by first support 411, second support 421, and the pair of (two) joints 400. Through-hole 410, which has a substantially rectangular shape as seen from the top, is formed across contact piece 40 in the operation direction. Through-hole 410 may have a size large enough for press unit 7 to move smoothly inside through-hole 410 in the operation direction. Thus, contact piece 40 is rectangular as seen from the top.

First support 411 and second support 421 are each formed into a rod shape so that their lengths become equal to each other in the right or left direction. Both first support 411 and second support 421 are supported by base 20. More specifically, first support 411 is supported by base 20 so as to be in contact with the first one of third fixture contacts 631 positioned in a front portion of the bottom surface of depression 21. Second support 421 is supported by base 20 so as to be in contact with the second one of third fixture contacts 631 positioned in a back portion of the bottom surface of depression 21.

Figure 5:
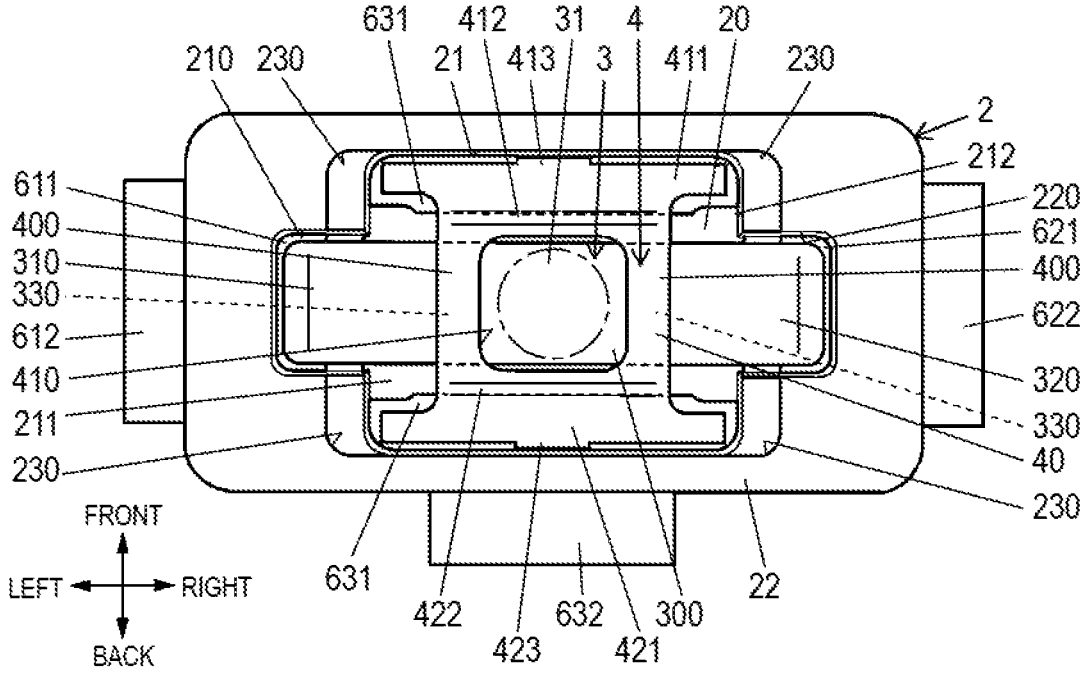
FIG. 5 is a plan view of the push switch from which a holding plate is further removed.
Figure 6:
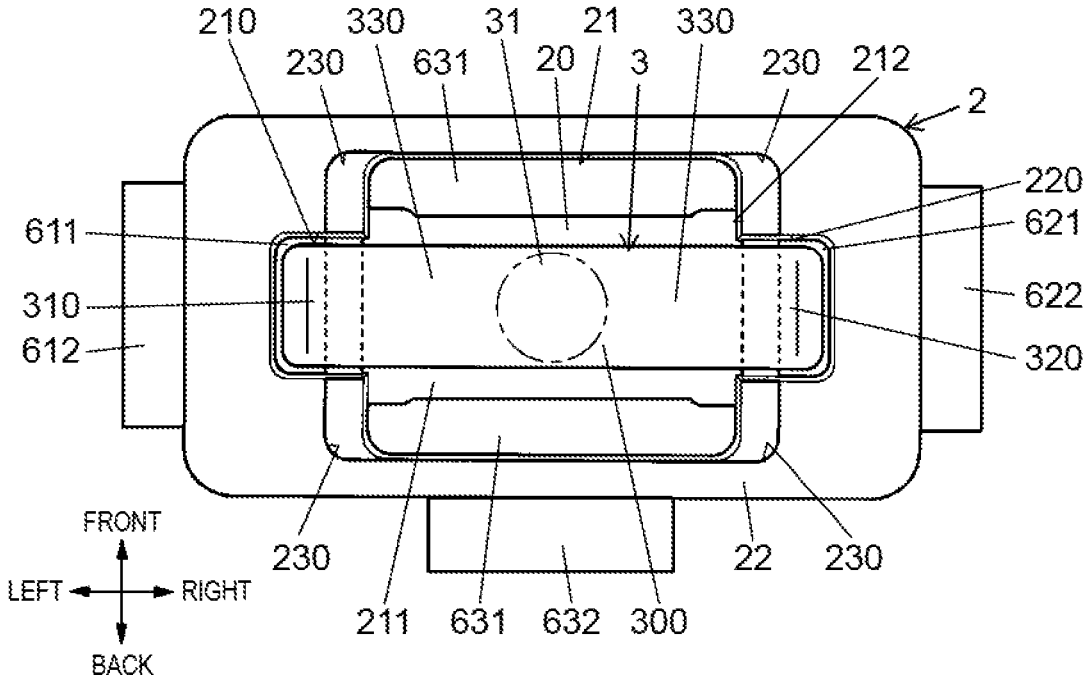
FIG. 6 is a plan view of the push switch from which a portion (contact piece) of a contact member is further removed.

First support 411 is provided with first projection 413 protruding forward, whereas second support 421 is provided with second projection 423 protruding backward. As illustrated in FIG. 5, when contact piece 40 is disposed inside depression 21 of case 2, first projection 413 makes contact with a portion of peripheral wall 22 positioned in front of depression 21, and second projection 423 makes contact with another portion of peripheral wall 22 positioned in back of depression 21. This configuration suppresses contact piece 40 from moving in a plane parallel to surface 211 of base 20.

The pair of joints 400 joins first support 411 to second support 421. The pair of joints 400 is formed into a rod shape having the seine length in the forward or backward direction. In this case, the length of the pair of joints 400 is equal to or greater than a width of movable member 3 (a length of movable member 3 in the forward or backward direction).

Contact piece 40 further includes first raised section 412 and second raised section 422. First raised section 412 is formed so as to rise up between first support 411 and the pair of joints 400. Second raised section 422 is formed so as to rise up between second support 421 and the pair of joints 400. Thus, the pair of joints 400 joins first support 411 to second support 421 at a location higher than both first support 411 and second support 421. As a result, a space in which movable member 3 is to be disposed is reserved between the lower surfaces of each of joints 400 and each of first support 411 and second support 421. More specifically, a distance between the lower surface of each joint 400 and each of the lower surfaces of first support 411 and second support 421 is set to be equal to or greater than a thickness of movable member 3 (a length of movable member 3 in the upward or downward direction). During the non-operation of push switch 1, however, movable member 3 is in contact with at least one of first support 411 and second support 421.

Movable joint 300 of movable member 3 is disposed between base 20 and the pair of joints 400 of contact piece 40. In this case, first support 411 and second support 421 of contact piece 40 are supported by base 20 on both sides of movable member 3 in the forward or backward direction. The forward or backward direction discussed herein corresponds to the second direction that intersects the first direction (right or left direction) in a plane orthogonal to the operation direction; the first direction is a direction in which first movable contact 310 and second movable contact 320 of movable member 3 are arrayed.

As described above, movable member 3 and contact member 4 (especially, contact piece 40) are disposed so as to intersect each other. Thus, third fixture contacts 631 can be positioned so as to deviate from a straight line along which first fixture contact 611 is aligned with second fixture contact 621. As a result, this configuration can position first fixture contact 611, second fixture contact 621, and third fixture contacts 631 at short distances from one another in the operation direction (upward or downward direction). In short, first fixture contact 611, second fixture contact 621, and third fixture contact 631 can be positioned at similar heights. Consequently, it is possible to achieve push switch 1 having a compact body. More specifically, it is possible to achieve a low-height body (thin body) in the operation direction.

Holding plate 8 is disposed such that at least a portion of holding plate 8 is accommodated in depression 21 of case 2. As described above, movable member 3, contact member 4, and holding plate 8 are stacked on top of each other in the upward or downward direction. Holding plate 8 is positioned on an opposite (upper) side of contact member 4 to surface 211 of base 20 in the operation direction (upward or downward direction).

Holding plate 8, made of a synthetic resin, possesses electrical insulation. Holding plate 8 includes first press bar 811, second press bar 821, and a pair of (two) coupling plates 800. In addition, holding plate 8 further includes window 810, which is surrounded by first press bar 811, second press bar 821, and the pair of coupling plates 800. Window 810, which has a substantially square shape as seen from the top, is formed across holding plate 8 in the operation direction. Window 810 may have a size large enough for press unit 7 to move smoothly inside window 810 in the operation direction. As described above, holding plate 8 is formed into a rectangular shape as seen from the top.

First press bar 811 and second press bar 821, each of which is formed into a rod shape, have the same length in the right or left direction. More specifically, the length of first press bar 811 and second press bar 821 is nearly equal to a distance between mutually opposing portions of inner surface 212 of depression 21 in the right or left direction. Both first press bar 811 and second press bar 821 are fixed to case 2. More specifically, first press bar 811 is fixed to case 2 in front of depression 21 so that both ends of first press bar 811 make contact with the mutually opposing portions of inner surface 212 of depression 21 in the right or left direction. Second press bar 821 is fixed to case 2 in back of depression 21 so that both ends of second press bar 821 make contact with the mutually opposing portions of inner surface 212 of depression 21 in the right or left direction. Both first press bar 811 and second press bar 821 are fixed to case 2 above the bottom surface of depression 21.

As described above, holding plate 8 is disposed on inner surface 212 of depression 21 so as to cover an area defined by inner surface 212. In typical push switch 1, case 2 may be deformed, for example, due to heat generated during reflow soldering by which push switch 1 is mounted on a printed circuit board. In which case, an aperture of depression 21 might be deformed and shrink. Providing holding plate 8 can reduce the deformation of case 2. In short, holding plate 8, especially both first press bar 811 and second press bar 821 fulfill a function of beams for depression 21 in the right or left direction.

Figure 12A:
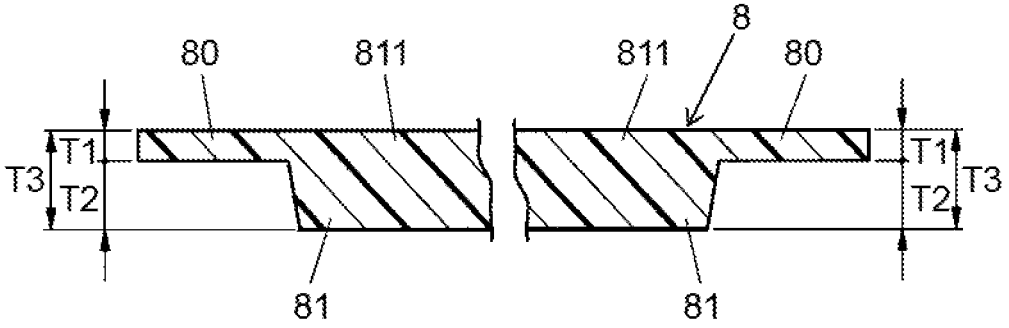
FIG. 12A is a partly enlarged schematic view of a cross section of the holding plate of the push switch.
Figure 12B:
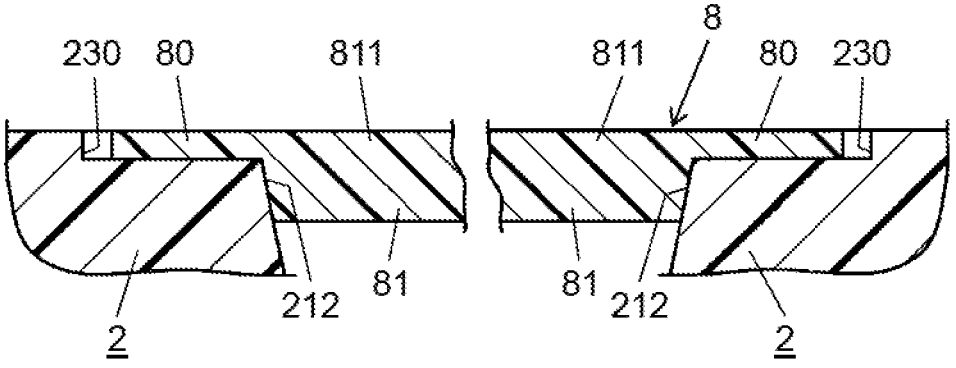
FIG. 12B is an enlarged schematic view of a cross section of fused portions of the holding plate and a base, which constitute the push switch.

As illustrated in FIG. 12A, holding plate 8 has fused sections 80 and non-fused sections 81. Fused sections 80 are provided in first press bar 811 and second press bar 821 (see FIG. 1), so as to protrude rightward and leftward from upper portions of (right and left) ends of first press bar 811 and second press bar 821. Holding plate 8 has four fused sections 80 at respective corners. As illustrated in FIG. 12B, fused sections 80 are parts of holding plate 8 which are to be fused to corresponding third recesses 230 of case 2 with laser irradiation. Details of this will be described later. Non-fused sections 81 are parts of holding plate 8 other than fused sections 80. Further, non-fused sections 81 are parts of holding plate 8 which are to be brought into contact with inner surface 212 of depression 21 of case 2. In short, non-fused sections 81 correspond to first press bar 811 and second press bar 821. Non-fused sections 81 are disposed so as to cover an area defined by opposing inner surface 219 of depression 21. FIGS. 12A and 12B illustrate first press bar 811 only, but this structure is applicable to second press bar 821.

As illustrated in FIG. 12A, thickness T1 of fused sections 80 in the operation direction is set to be smaller than thickness T2 (=T3−T1), which is equal to a difference between thickness T3 of non-fused sections 81 and thickness T1 of fused sections 80. Setting the thickness of fused sections 80 to be smaller can reduce an amount of heat necessary to fuse fused sections 80 with a laser. In addition, setting non-fused sections 81 to be greater can ensure the beam functions of first press bar 811 and second press bar 821. If thickness T1 of fused sections 80 is greater than thickness T2, heat capacity of fused sections 80 increases, in which case the amount of heat necessary to fuse fused sections 80 with a laser may increase. In addition, unnecessary portions of holding plate 8 which are not related to fusing may also be fused. For this reason, a thickness of fused section 80 needs to be set to a minimum value necessary for fusing.

Figure 4:
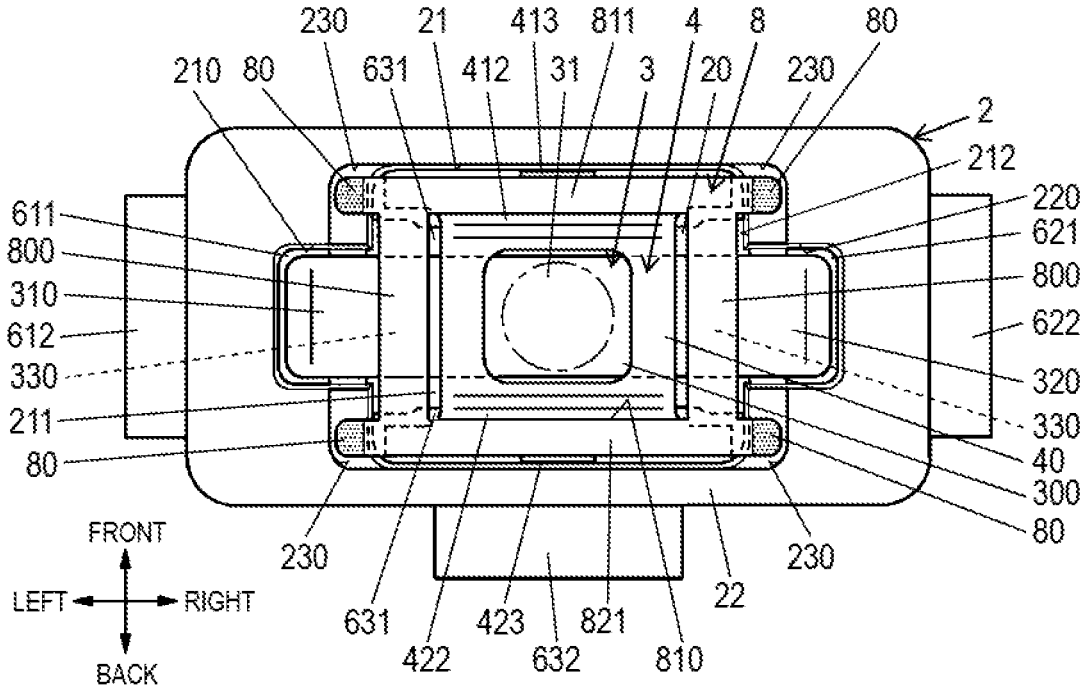
FIG. 4 is a plan view of the push switch from which a protective sheet and a press unit are removed.

Fused sections 80 are disposed in third recesses 230. More specifically, left ones of fused sections 80 of first press bar 811 and second press bar 821 are disposed on upper surfaces of third recesses 230 on both sides of first recess 210. Right ones of fused sections 80 of first press bar 811 and second press bar 821 are disposed on upper surfaces of third recesses 230 on both sides of second recess 220. By irradiating the upper surfaces of fused sections 80 with a laser, fused sections 80 are fused to the upper surfaces of corresponding third recesses 230. In FIG. 4, four fused parts are shaded by dots. In this way, holding plate 8 is fused to case 2. Since portions of holding plate 8 are fused to portions of case 2, holding plate 8 can be bonded firmly to case 2. This configuration does not involve using other members, such as adhesive. Thus, the configuration can also suppress push switch 1 from behaving unstably due to such members adhering to contact points. In this case, contact member 4 (especially, contact piece 40) is disposed between base 20 and holding plate 8. Thus, holding plate 8 fixes contact member 4 to case 2.

Protective sheet 5 is a flexible sheet made of a synthetic resin. In this case, protective sheet 5 is made of a resin film that possesses heat resistance and electrical insulation. Protective sheet 5 is disposed on the upper surface of case 2 (over the aperture of depression 21) so as to cover entire depression 21. Protective sheet 5 is bonded to a portion of case 2 around depression 21, namely, the upper surface of peripheral wall 22 of case 2, thereby covering depression 21. Protective sheet 5 thereby protects contacts accommodated in depression 21 by suppressing entry of dust, water, gas, or other foreign matter, for example, in depression 21. Such contacts include first fixture contact 611, second fixture contact 621, third fixture contacts 631, first movable contact 310, second movable contact 320, and third movable contact 330. An outer circumferential shape of protective sheet 5 is substantially the same as an outer circumferential shape of peripheral wall 22 of case 2 but slightly larger than peripheral wall 22. More specifically, protective sheet 5 has a rectangular shape with its four corners chamfered, as seen from the top. However, the chamfering is not essential to push switch 1 and thus may be optional.

More specifically, protective sheet 5 includes coupling section 51, press section 52, and middle section 53. Protective sheet 5 is bonded to peripheral wall 22 of case 2 through coupling section 51, with press section 52 and middle section 53 covering depression 21.

Coupling section 51 is bonded to the upper surface of peripheral wall 22. In this case, coupling section 51 is provided in a rectangular, flat peripheral portion of protective sheet 5 which is parallel to surface 211 of base 20. Coupling section 51 is formed of a linear region having a predetermined width which is positioned slightly inside and along an outer circumferential edge of protective sheet 5. Coupling section 51 is bonded to a portion of case 2 around depression 21 with welding. In this configuration, the lower surface of protective sheet 5 is not coated with any adhesive material, as opposed to a configuration in which coupling section 51 is bonded to case 2 with an adhesive material. In this exemplary embodiment, coupling section 51 is bonded to the portion of case 2 around depression 21 with laser welding. As shaded areas with dots in FIGS. 2 and 3, coupling section 51 is bonded to an entire peripheral portion of case 2 around depression 21.

Press section 52 faces pressure receiving section 31 of movable member 3. In this exemplary embodiment, press section 52 faces pressure receiving section 31 of movable member 3 with window 810 of holding plate 8 and through-hole 410 of contact member 4 in-therebetween. In this case, a central, circular portion of protective sheet 5 forms press section 52. Press section 52 is a flat part positioned parallel to surface 211 of base 20.

Middle section 53 is positioned between coupling section 51 and press section 52. In this case, portions of protective sheet 5 other than coupling section 51 and press section 52 form middle section 53. In short, all portions of protective sheet 5 which are surrounded by coupling section 51 and exclude press section 52 constitute middle section 53.

Press unit 7 is positioned on an opposite side of contact member 4 to surface 211 of base 20 in the operation direction (upward or downward direction). More specifically, press unit 7 is disposed between press section 52 of protective sheet 5 and pressure receiving section 31 of movable member 3. Press unit 7, made of a synthetic resin, possesses electrical insulation. Press unit 7 has a shape of a flat disk in the upward or downward direction. Press unit 7 is disposed above movable member 3 with its lower surface being in contact with the upper surface of pressure receiving section 31. The upper surface of press unit 7 is bonded to the lower surface of press section 52 with laser welding, for example.

Press unit 7 transfers the operation force that has been applied to press section 52 of protective sheet 5 to pressure receiving section 31 of movable member 3. When acting on press section 52 from the top, an operation force is transferred to pressure receiving section 31 via press unit 7 and then acts on pressure receiving section 31 from the top. In short, a user can indirectly operate pressure receiving section 31 through press unit 7 by pressing down press section 52.

(2.2) Operation

Figure 10A:
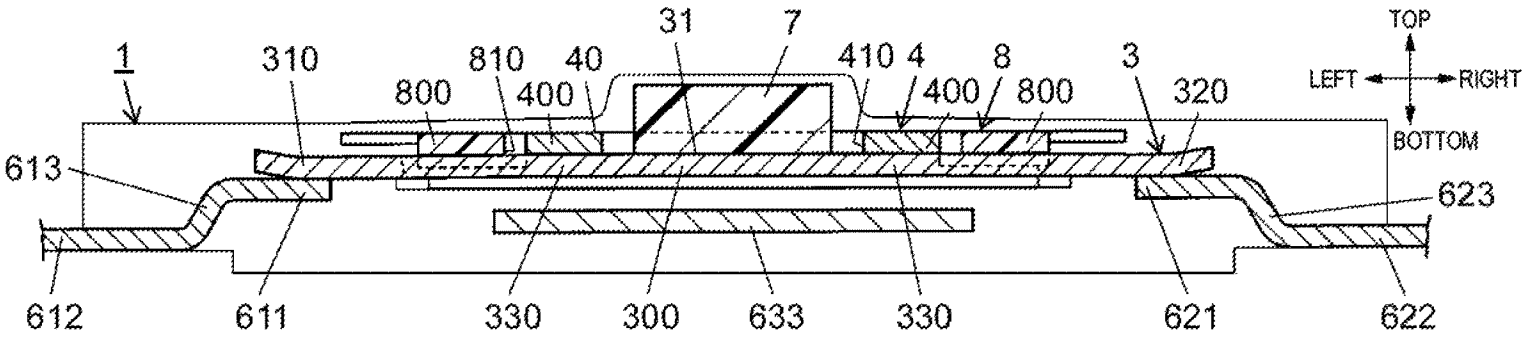
FIG. 10A is a schematic view of a cross section of the push switch during non-operation.
Figure 10B:
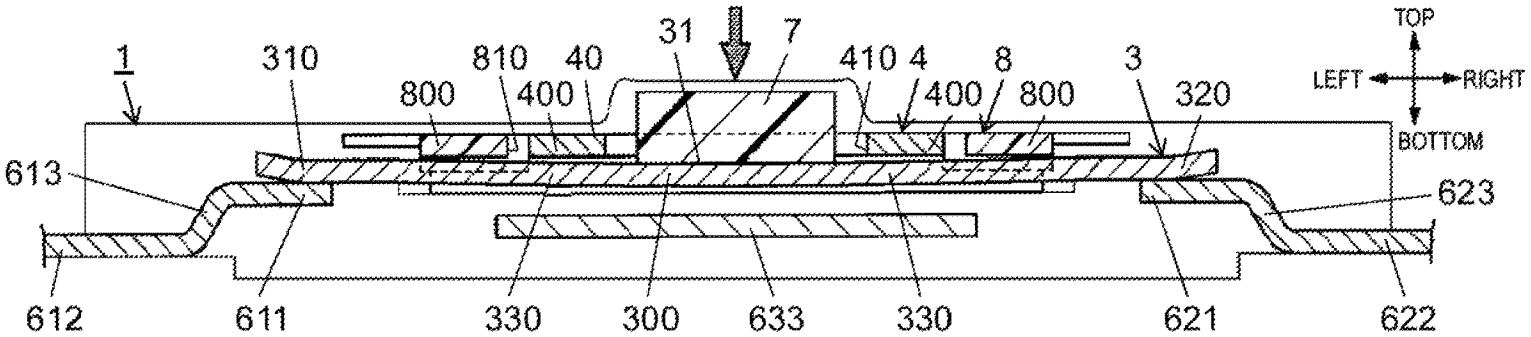
FIG. 10B is a schematic view of a cross section of the push switch during an operation in a first stage.
Figure 10C:
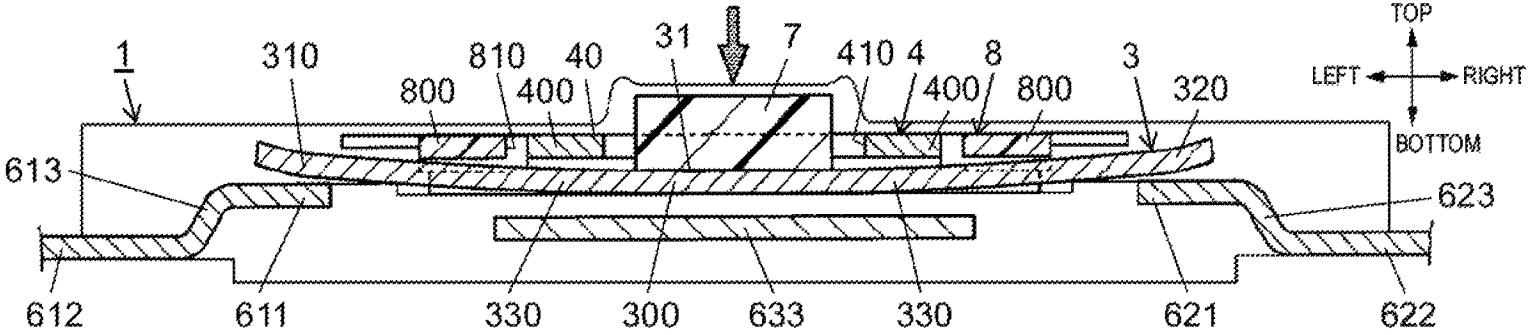
FIG. 10C is a schematic view of a cross section of the push switch during an operation in a second stage.

Next, a description will be given of an operation of push switch 1 configured above, with reference to FIGS. 10A to 10C. FIGS. 10A to 10C each schematically illustrate a cross section of push switch 1 corresponding to FIG. 8.

Non-operation states of push switch 1 include a state where push switch 1 is net pressed down, namely, no external force acts on movable joint 300 (including pressure receiving section 31) of movable member 3. Operations of push switch 1 include the operations in the first and second stages. One difference between the operations in the first and second stages is the movement distance (displacement amount) of pressure receiving section 31. More specifically, the movement distance (displacement amount) of pressure receiving section 31 in the operation in the first stage is shorter than the movement distance (displacement amount) of pressure receiving section 31 in the operation in the second stage, relative to the position of pressure receiving section 31 in the non-operation. Push switch 1 assures a "stationary state" in the non-operation, a "first operation state" in the operation in the first stage, and a "second operation state" in the operation in the second stage.

Push switch 1 is a normally-closed switch. More specifically, push switch 1 is configured such that the two circuits are turned on or off. For the sake of expediency, a first circuit that is turned off in the first operation state is referred to as a first circuit, whereas a second circuit that is turned off in the second operation state is referred to as a second circuit.

The first circuit is a circuit having first terminal 612 and second terminal 622. Furthermore, the first circuit is a circuit that includes first fixture contact 611, second fixture contact 621, first movable contact 310, and second movable contact 320. The second circuit is a circuit that includes first terminal 612 and third terminal 632. Moreover, the second circuit is a circuit that includes first fixture contact 611, third fixture contacts 631, first movable contact 310, and third movable contact 330. The two circuits, or the first and second circuits, share first terminal 612 as a common terminal.

Figure 11A:
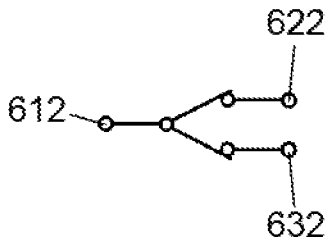
FIG. 11A is an explanatory diagram of an equivalent circuit of the push switch during the non-operation.

First, a description will be given of the non-operation state (stationary state) of push switch 1 in FIG. 10A. During the non-operation of push switch 1, no external force acts on pressure receiving section 31. First fixture contact 611 is electrically connected to contact member 4, and first fixture contact 611 is electrically connected to second fixture contact 621. In other words, during the non-operation of push switch 1, first fixture contact 611 is electrically connected to first movable contact 310, and second fixture contact 621 is electrically connected to second movable contact 320. As a result, electricity is conducted between first terminal 612 and second terminal 622. In this case, the first circuit is in an ON state. Furthermore, first fixture contact 611 is electrically connected to third fixture contacts 631 through contact piece 40. As a result, electricity is conducted between first terminal 612 and third terminal 632. In this case, the second circuit is also in an ON state. FIG. 11A illustrates an equivalent circuit diagram of push switch 1 during the non-operation.

Second, a description will be given of the operation state (first operation state) of push switch 1 in the first stage in FIG. 10B. During the operation of push switch 1 in the first stage, an operation force acts on pressure receiving section 31 from the top through press unit 7. In response, pressure receiving section 31 is pressed (downward) toward the bottom (surface 211) of depression 21, and movable member 3 is thereby gradually deformed. This deformation is elastic deformation in which movable joint 300 of movable member 3 is warped downward.

Figure 11B:
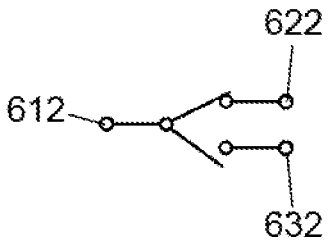
FIG. 11B is an explanatory diagram of an equivalent circuit of the push switch during the operation in the first stage.

When push switch 1 transits from the stationary state to the first operation state where press unit 7 presses pressure receiving section 31 toward surface 211 (namely, the bottom surface of depression 21) of base 20 in the operation direction, third movable contact 330 becomes separated from contact member 4, thereby breaking off the electrical connection between first fixture contact 611 and contact member 4. In other words, in response to the elastic deformation of movable member 3, third movable contact 330 of movable joint 300 is displaced downward and then separated from the lower surface of joint 400 of contact piece 40. This operation breaks off the electrical connection between first fixture contact 611 and each third fixture contact 631 through contact piece 40, thereby terminating the conduction between first terminal 612 and third terminal 632. As a result, the second circuit enters an OFF state. However, even when movable member 3 is elastically deformed to some degree, the electrical connections between first fixture contact 611 and first movable contact 310 and between second fixture contact 621 and second movable contact 320 are still maintained. As a result, the conduction between first terminal 612 and second terminal 622 is maintained. In this way, the first circuit is left in the ON state. FIG. 11B illustrates an equivalent circuit diagram of push switch 1 during the operation in the first stage.

Third, a description will be given of the operation (second operation state) of push switch 1 in the second stage in FIG. 10C. The operation of push switch 1 in the second stage is performed subsequent to the operation in the first stage. During the operation of push switch 1 in the second stage, the operation force further acts on pressure receiving section 31 that has been in the state of FIG. 10B, from the top through press unit 7. Then, pressure receiving section 31 is pressed (down) toward the bottom surface (surface 211) of depression 21. Movable joint 300 of movable member 3 is thereby further warped downward. As a result, a deformation amount, in the second stage, of movable member 3 (movable joint 300) that has been in the stationary state is larger than a deformation amount of movable member 3 in the first stage.

Figure 11C:
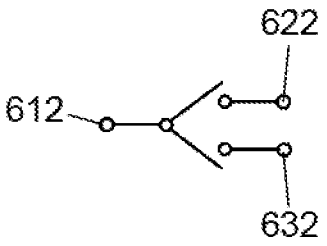
FIG. 11C is an explanatory diagram of an equivalent circuit of the push switch during the operation in the second stage.

In the second operation state where press unit 7 further presses pressure receiving section 31 that has been in the first operation state, first movable contact 310 is separated from first fixture contact 611, and second movable contact 320 is separated from second fixture contact 621. The electrical connection between first fixture contact 611 and second fixture contact 621 is thereby broken off. In other words, in response to further elastic deformation of movable member 3, first movable contact 310 is displaced upward and separated from first fixture contact 611. In addition, second movable contact 320 is displaced upward and separated from second fixture contact 621. The electrical connection between first fixture contact 611 and second fixture contact 621 through movable member 3 is thereby broken off. As a result, the conduction between first terminal 612 and second terminal 622 is terminated. In this way, the first circuit enters the OFF state. No electricity is conducted between first terminal 612 and third terminal 632 continuously from the operation in the first stage. In this way, the second circuit is also in the OFF state. FIG. 11C illustrates an equivalent circuit diagram of push switch 1 during the operation in the second stage.

Modifications

Some modifications of the foregoing exemplary embodiment will be described below.

In the foregoing exemplary embodiment, base 20 is a portion of case 2. However, base 20 does not necessarily have to be a portion of case 2. As an alternative example, base 20 may be a portion of the printed circuit board (wiring substrate). In this case, movable member 3, contact member 4, and holding plate 8 are mounted on surface 211 of the printed circuit board that forms base 20.

The aperture shape of depression 21 in push switch 1 does not necessarily have to be a substantially rectangular shape. As an alternative example, the aperture shape may be a square, circular, or elliptical shape. In this configuration, shapes of movable member 3, contact member 4, holding plate 8, and protective sheet 5 are determined in accordance with the aperture shape of depression 21. A shape of through-hole 410 formed in contact member 4 (especially, contact piece 40) does not necessarily have to be a substantially square shape. As an alternative example, the shape of through-hole 410 may be a triangular, rectangular, trapezoidal, or elliptical shape. Also, a shape of window 810 formed in holding plate 8 does not necessarily have to be a square shape. As an alternative example, the shape of window 810 may be a triangular, rectangular, trapezoidal, or elliptical shape.

In the foregoing exemplary embodiment, third fixture contacts 631 and contact piece 40, which constitute contact member 4, are independent members. However, third fixture contacts 631 and contact piece 40 may be integrated with each other. For example, contact member 4, made of a single metal plate, may have third fixture contacts 631 and contact piece 40. However, it should be noted that push switch 1 in which third fixture contacts 631 and contact piece 40 are independent members can be assembled easier than push switch 1 in which third fixture contacts 631 and contact piece 40 are integrated with each other.

Third terminal 632 may protrude from either the right or left surface of case 2 in the right or left direction.

Figure 13A:
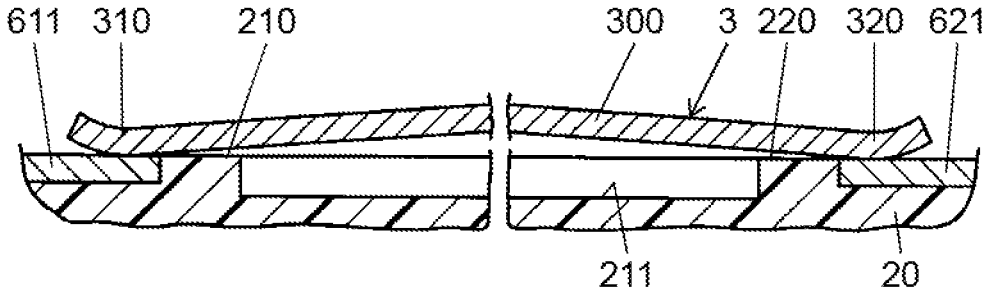
FIG. 13A is a partly schematic view of a cross section of a push switch according to a first modification of the exemplary embodiment of the present disclosure.

When no external force acts on movable member 3, movable joint 300 may be warped apart from surface 211 of base 20. In other words, when push switch 1 is not operated, movable member 3 may be warped upward. As illustrated in FIG. 13A, a gap is reserved between the bottom surface of first recess 210 and the lower surface of movable member 3 on the right side of first movable contact 310. Likewise, a gap is reserved between the bottom surface of second recess 220 and the lower surface of movable member 3 on the left side of second movable contact 320. Even if movable member 3 is displaced downward until these gaps are eliminated, first movable contact 310 can be kept in contact with first fixture contact 611, and second movable contact 320 can also be kept in contact with second fixture contact 621. Thus, even when movable member 3 is displaced downward to some degree, first movable contact 310 does not easily become separated from first fixture contact 611, and second movable contact 320 does not easily become separated from second fixture contact 621. In short, during the operation of push switch 1 in the first stage, the electrical connections between first movable contact 310 and first fixture contact 611 and between second movable contact 320 and second fixture contact 621 are not broken off.

Figure 13B:
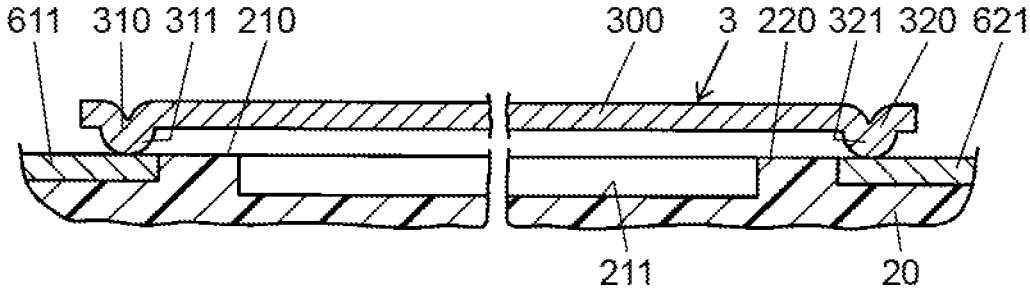
FIG. 13B is a partly schematic view of a cross section of a push switch according to a second modification of the exemplary embodiment of the present disclosure.

As illustrated in FIG. 13B, first movable contact 310 may have first projection 311 facing first fixture contact 611. Via first projection 311, first movable contact 310 may be electrically connected to first fixture contact 611. Likewise, second movable contact 320 may have second projection 321 facing second fixture contact 621. Via second projection 321, second movable contact 320 may be electrically connected to second fixture contact 621. In this case, first projection 311 reserves a gap between the bottom surface of first recess 210 and the lower surface of movable member 3 on the right side of first movable contact 310. Likewise, second projection 321 reserves a gap between the bottom surface of second recess 220 and the lower surface of movable member 3 on the left side of second movable contact 320. As a result, similar to the case of FIG. 13A, the electrical connections between first movable contact 310 and first fixture contact 611 and between second movable contact 320 and second fixture contact 621 are not broken off during the operation of push switch 1 in the first stage.

Figure 13C:
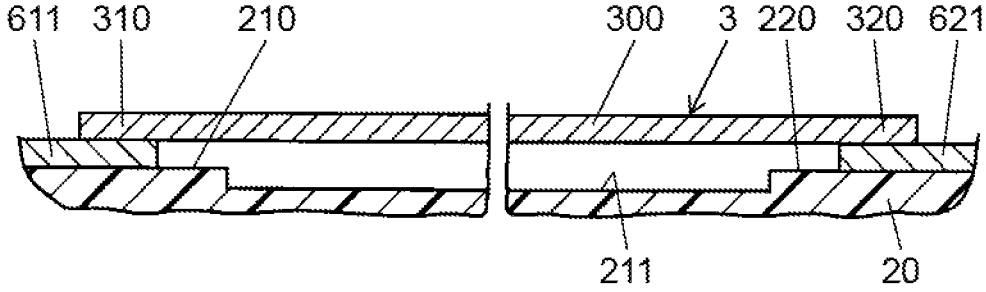
FIG. 13C is a partly schematic view of a cross section of a push switch according to a third modification of the exemplary embodiment of the present disclosure.

As illustrated in FIG. 13C, first fixture contact 611 may be provided so as to protrude upward from the bottom surface of first recess 210. Likewise, second fixture contact 621 may be provided so as to protrude upward from the bottom surface of second recess 220. This configuration creates steps between first fixture contact 611 and the bottom surface of first recess 210 and between second fixture contact 621 and the bottom surface of second recess 220. In this case, since the upper surface of first fixture contact 611 is positioned higher than the bottom surface of first recess 210, a gap is reserved between the bottom surface of first recess 210 and the lower surface of movable member 3 on the right side of first movable contact 310. Likewise, since the upper surface of second fixture contact 621 is positioned higher than the bottom surface of second recess 220, a gap is reserved between the bottom surface of second recess 220 and the lower surface of movable member 3 on the left side of second movable contact 320. As a result, similar to the cases of FIGS. 13A and 13B, the electrical connections between first movable contact 310 and first fixture contact 611 and between second movable contact 320 and second fixture contact 621 are not broken off during the operation of push switch 1 in the first stage.

Push switch 1 does not necessarily have to be provided in an operation section of a certain device and operated by an operator. As an alternative example, push switch 1 may be provided in a sensor of a certain device. If provided in a sensor of a certain device, push switch 1 may be used as a limit switch to detect a location of a mechanical component of an actuator, for example.

Instead of between press section 52 and pressure receiving section 31, for example, press unit 7 may be disposed above press section 52. In this case, the lower surface of press unit 7 is bonded to the upper surface of protective sheet 5. In this configuration, the operation force acting on press unit 7 is transferred to pressure receiving section 31 through press section 52.

Conclusion

As described above, push switch 1 according to a first aspect includes first fixture contact 611, second fixture contact 621, a member, movable member 3, and contact member 4. In this case, case 2 will be described as the member. Case 2 holds first fixture contact 611 and second fixture contact 621. Movable member 3 is positioned opposite surface 211 of base 20 in an operation direction (upward or downward direction). Contact member 4 that possesses electrical conductivity is positioned on an opposite side of movable member 3 to surface 211 of base 20 in the operation direction. Movable member 3 includes first movable contact 310, second movable contact 320, and movable joint 300. First movable contact 310 moves between locations at which first movable contact 310 is in contact with first fixture contact 611 and at which first movable contact 310 is separated from first fixture contact 611. Second movable contact 320 moves between locations at which second movable contact 320 is in contact with second fixture contact 621 and at which second movable contact 320 is separated from second fixture contact 621. Movable joint 300 joins first movable contact 310 to second movable contact 320 and electrically connects first movable contact 310 to second movable contact 320. Contact member 4 includes: first support 411 and second support 421 that are supported by base 20; and joint 400 that joins first support 411 to second support. 421. Movable joint 300 is disposed between joint 400 and base 20, with neither first support 411 nor second support 421 overlapping movable member 3 in a planar view.

According to the above configuration, movable member 3 and contact member 4 are disposed so as to intersect each other. Thus, third fixture contacts 631 can be positioned so as to deviate from a straight line along which first fixture contact 611 is aligned with second fixture contact 621. This configuration can position first fixture contact 611, second fixture contact 621, and third fixture contacts 631 at short distances from one another in the operation direction. Consequently, the configuration positions first fixture contact 611, second fixture contact 621, and third fixture contact 631 at similar heights, thereby successfully and advantageously achieving a compact body.

In push switch 1 according to the foregoing first aspect, the member is formed of case 2. However, the member does not necessarily have to be formed of case 2. As an alternative example, the member may include a wiring substrate.

Push switch 1 according to a second aspect further includes press unit 7 in addition to the configuration of the first aspect. Press unit 7 is positioned on an opposite side of movable member 3 to surface 211 of base 20 in the operation direction. Movable joint 300 includes third movable contact 330. The third movable contact has the pressure receiving section. Third movable contact 330 moves between locations at which pressure receiving section 31 is in contact with contact member 4 and at which pressure receiving section 31 is separated from contact member 4. In a stationary state where no external force acts on pressure receiving section 31, first fixture contact 611 is electrically connected to contact member 4, and first fixture contact 611 is electrically connected to second fixture contact 621. When the stationary state is transited to the first operation state where pressure receiving section 31 is pressed through press unit 7 toward surface 211 of base 20 in the operation direction (upward or downward direction), third movable contact 330 becomes separated from contact member 4, thereby breaking off the electrical connection between first fixture contact 611 and contact member 4. When the first operation state is transited to the second operation state where pressure receiving section 31 is further pressed through press unit 7, first movable contact 310 becomes separated from first fixture contact 611, and second movable contact 320 becomes separated from second fixture contact 621. The electrical connection between first fixture contact 611 and second fixture contact 621 is thereby broken off.

In the stationary state where no external force acts on pressure receiving section 31, the configuration can turn on the first circuit that includes first fixture contact 611, first movable contact 310, third movable contact 330, and contact member 4. Also, the configuration can turn on the second circuit that includes first fixture contact 611, first movable contact 310, second movable contact 320, and second fixture contact 621.

A state where an external force acts on pressure receiving section 31 includes two stages.

In the first stage (first operation state), the above first circuit can be turned off, because third movable contact 330 becomes separated from contact member 4 to break off the electrical connection between first fixture contact 611 and contact member 4. In this stage, however, the above second circuit can be kept in the ON state, because first fixture contact 611 is still electrically connected to second fixture contact 621.

In the second stage (second operation state), the above second circuit can also be turned off, because first movable contact 310 becomes separated from first fixture contact 611 and second movable contact 320 becomes separated from second fixture contact 621, to break off the electrical connection between first fixture contact 611 and second fixture contact 621.

As described above, push switch 1 is a normally-closed switch. In addition, push switch 1 can independently turn off two circuits in two stages.

Push switch 1 according to a third aspect has, in addition to the configuration of the first or second aspect, a configuration in which contact member 4 includes third fixture contact 631 and contact piece 40. Third fixture contact 631 is held by the member (case 2 in this case). Contact piece 40 is electrically connected to third fixture contacts 631. At least a portion of contact piece 40 is positioned on an opposite side of movable member 3 to surface 211 of base 20 in the operation direction.

The above configuration, which can handle third fixture contacts 631 and contact piece 40 as independent members, enables push switch 1 to be assembled easily. The configuration is effective especially when push switch 1 is compact.

REFERENCE MARKS IN THE DRAWINGS

1 push switch
2 case (member)
3 movable member
4 contact member
7 press unit
8 holding plate
20 base (member)
21 depression
22 peripheral wall
31 pressure receiving section
40 contact piece
51 coupling section
52 press section
53 middle section
61, 62, 63 metal member
80 fused section
81 non-fused section
210 first recess
211 surface
212 inner surface
220 second recess
230 third recess
300 movable joint
310 first movable contact
311, 321 projection
320 second movable contact
330 third movable contact
400 joint
410 through-hole
411 first support
412 first raised section
413 projection
421 second support
422 second raised section
423 projection
611 first fixture contact
612 first terminal
613 first main plate
621 second fixture contact
622 second terminal
623 second main plate
631 third fixture contact
632 third terminal
633 third main plate
634 sub-plate
800 coupling plate
810 window
811 first press bar
821 second press bar

The invention claimed is:

1. A push switch comprising:

a first fixture contact;

a second fixture contact;

a member that holds the first fixture contact and the second fixture contact;

a movable member positioned opposite a surface of the member in an operation direction;

a contact member that possesses electrical conductivity, the contact member being positioned on an opposite side of the movable member to the surface of the member in the operation direction; and a press unit positioned on an opposite side of the movable member to the surface of the member in the operation direction, wherein the movable member includes a first movable contact, a second movable contact, and a movable joint, the first movable contact moving between a location at which the first movable contact is in contact with the first fixture contact and a location at which the first movable contact is separated from the first fixture contact, the second movable contact moving between a location at which the second movable contact is in contact with the second fixture contact and a location at which the second movable contact is separated from the second fixture contact, the movable joint joining the first movable contact to the second movable contact, the movable joint electrically connecting the first movable contact to the second movable contact, the contact member includes a first support and a second support that are supported by the member and a joint that joins the first support to the second support, the movable joint is disposed between the joint and the member, and neither the first support nor the second support overlaps the movable member in a planar view, wherein the movable joint includes a third movable contact, the third movable contact has a pressure receiving section, the third movable contact moves between a location at which the third movable contact is in contact with the contact member and a location at which the third movable contact is separated from the contact member, in a stationary state where no external force acts on the pressure receiving section, the first fixture contact is electrically connected to the contact member, and the first fixture contact is electrically connected to the second fixture contact, when the stationary state is transited to a first operation state where the pressure receiving section is pressed through the press unit toward the surface of the member in the operation direction, the third movable contact becomes separated from the contact member to break off an electrical connection between the first fixture contact and the contact member, and when the first operation state is transited to a second operation state where the pressure receiving section is further pressed through the press unit, the first movable contact becomes separated from the first fixture contact and the second movable contact becomes separated from the second fixture contact, to break off an electrical connection between the first fixture contact and the second fixture contact.

2. The push switch according to claim 1, wherein the member includes a case.

3. The push switch according to claim 2, wherein the member further includes a wiring substrate.

4. The push switch according to claim 1, wherein the contact member includes a third fixture contact and a contact piece, the third fixture contact is held by the member, the contact piece is electrically connected to the third fixture contact, and at least a portion of the contact piece is positioned on an opposite side of the movable member to the surface of the member in the operation direction.

5. A push switch comprising:

a first fixture contact;

a second fixture contact;

a member that holds the first fixture contact and the second fixture contact;

a movable member positioned opposite a surface of the member in an operation direction; and a contact member that possesses electrical conductivity, the contact member being positioned on an opposite side of the movable member to the surface of the member in the operation direction, wherein the movable member includes a first movable contact, a second movable contact, and a movable joint, the first movable contact moving between a location at which the first movable contact is in contact with the first fixture contact and a location at which the first movable contact is separated from the first fixture contact, the second movable contact moving between a location at which the second movable contact is in contact with the second fixture contact and a location at which the second movable contact is separated from the second fixture contact, the movable joint joining the first movable contact to the second movable contact, the movable joint electrically connecting the first movable contact to the second movable contact, the contact member includes a first support and a second support that are supported by the member and a joint that joins the first support to the second support, the movable joint is disposed between the joint and the member, neither the first support nor the second support overlaps the movable member in a planar view, the contact member has a through-hole surrounded by the first support, the second support and the joint, the movable joint of the movable member has a pressure receiving section, and the pressure receiving section overlaps the through-hole of the contact member.

6. The push switch according to claim 5, wherein the member includes a case.

7. The push switch according to claim 6, wherein the member further includes a wiring substrate.

* * * * *